US009669959B2

(12) United States Patent
Luburic

(10) Patent No.: US 9,669,959 B2
(45) Date of Patent: Jun. 6, 2017

(54) CONTAINER WITH INTEGRATED HANDLES

(71) Applicant: BWAY Corporation, Atlanta, GA (US)

(72) Inventor: Frano Luburic, Costa Mesa, CA (US)

(73) Assignee: BWAY Corporation, Atlanta, GA (US)

( * ) Notice: Subject to any disclaimer, the term of this patent is extended or adjusted under 35 U.S.C. 154(b) by 0 days.

(21) Appl. No.: 14/670,163

(22) Filed: Mar. 26, 2015

(65) Prior Publication Data

US 2016/0280423 A1 Sep. 29, 2016

(51) Int. Cl.

| | |
|---|---|
| ***B65D 25/00*** | (2006.01) |
| ***B65D 8/00*** | (2006.01) |
| ***B65D 6/02*** | (2006.01) |
| ***B65D 25/28*** | (2006.01) |
| ***B65D 25/32*** | (2006.01) |
| ***B65D 1/16*** | (2006.01) |
| ***B65D 1/18*** | (2006.01) |

(52) U.S. Cl.

CPC ..... *B65D 7/04* (2013.01); *B65D 1/16* (2013.01); *B65D 1/18* (2013.01); *B65D 7/06* (2013.01); *B65D 25/2808* (2013.01); *B65D 25/2885* (2013.01); *B65D 25/2897* (2013.01); *B65D 25/32* (2013.01)

(58) Field of Classification Search

CPC .... B65D 25/32; B65D 25/50; B65D 25/2885; B65D 25/2897; B65D 25/2805

USPC ..... 220/771, 669, 752, 780

See application file for complete search history.

(56) References Cited

U.S. PATENT DOCUMENTS

| | | | | | |
|---|---|---|---|---|---|
| 3,198,377 | A * | 8/1965 | Buckley | A47J 43/27 | 220/771 |
| 3,379,341 | A | 4/1968 | Miles | | |
| D220,973 | S | 6/1971 | Yates | | |
| 3,829,926 | A * | 8/1974 | Salladay | B44D 3/126 | 15/257.06 |
| D236,320 | S | 8/1975 | Renou | | |
| 4,357,042 | A | 11/1982 | Gall | | |
| 4,431,326 | A * | 2/1984 | Braithwaite | B05C 17/002 | 220/254.7 |
| 4,967,918 | A * | 11/1990 | Long | A47G 19/2205 | 215/385 |
| 5,207,348 | A * | 5/1993 | Fischer | B44D 3/123 | 220/697 |
| D350,425 | S * | 9/1994 | Walker | B65F 1/00 | D32/53.1 |
| D352,143 | S | 11/1994 | Arshinoff | | |
| 5,390,818 | A * | 2/1995 | LaBuda | B65F 1/068 | 141/390 |

(Continued)

*Primary Examiner* — Anthony Stashick
*Assistant Examiner* — Ernesto Grano
(74) *Attorney, Agent, or Firm* — Morris, Manning & Matrin, LLP; Daniel E. Sineway, Esq.; Bryan D. Stewart, Esq.

(57) ABSTRACT

An exemplary container for storing and transporting materials is disclosed. In various embodiments, the exemplary container includes one or more handles for assisting a user with lifting the exemplary container and/or controlling the exemplary container when pouring the exemplary container's contents. The one or more handles, in particular embodiments, are designed for minimum interference with other similar containers during transport. In some embodiments, certain handles are recessed within a cavity of a sidewall of the exemplary container.

12 Claims, 9 Drawing Sheets

(56) References Cited

U.S. PATENT DOCUMENTS 5,456,357 A * 10/1995 Wenner ..... A47L 13/51 206/372
5,547,104 A * 8/1996 Parker ..... B65F 1/12 220/769
5,735,422 A 4/1998 Binter et al.
5,803,303 A * 9/1998 Timm ..... B65F 1/068 220/495.04
5,806,709 A * 9/1998 Marshall, II ..... B44D 3/14 220/755
5,964,372 A 10/1999 Dubois et al.
6,199,718 B1 * 3/2001 Ellis ..... B44D 3/126 220/570
6,308,858 B1 * 10/2001 Koefelda ..... B65D 1/22 220/608
6,471,221 B1 * 10/2002 McGarry ..... B65F 1/068 220/772
D469,233 S * 1/2003 Begnani ..... B65F 1/00 D32/53
D493,929 S 8/2004 Schwarz
6,808,081 B1 * 10/2004 Citro ..... B65D 25/2805 116/63 P
7,172,088 B2 * 2/2007 McDade ..... B65F 1/04 220/23.87
D545,519 S * 6/2007 King ..... B65F 1/00 D32/53
7,399,017 B1 * 7/2008 Lasseigne ..... A47J 47/18 16/425
D590,561 S 4/2009 Baltz
D623,373 S 9/2010 Rockwell, III et al.
D626,303 S 10/2010 Loverbos
7,938,292 B2 * 5/2011 Chornenky ..... B65D 25/30 220/676
8,210,391 B2 7/2012 Luburic
8,256,640 B2 9/2012 Luburic et al.
8,281,952 B2 * 10/2012 Robellard ..... B44D 3/126 220/501
8,438,921 B1 * 5/2013 Bland ..... B65D 25/56 73/426
D683,920 S * 6/2013 Bonafide ..... B65F 1/00 D32/53
D684,327 S 6/2013 Bonafide
D684,328 S 6/2013 Vasilakes et al.
8,459,490 B1 * 6/2013 McTaggart ..... A47J 47/00 220/574
8,757,428 B2 * 6/2014 Daudelin ..... B65F 1/06 220/761
D709,263 S * 7/2014 Carnesecca ..... B65F 1/00 D32/53
8,806,803 B1 * 8/2014 Mitchell ..... A01K 97/05 206/315.11
8,881,930 B2 * 11/2014 Banik ..... B65F 1/16 220/212.5
D726,385 S * 4/2015 O'Leary ..... B65F 1/00 D32/53
9,067,462 B1 * 6/2015 Pressler ..... A46B 17/02
D739,626 S 9/2015 Condiff
D739,627 S 9/2015 Condiff
D743,136 S 11/2015 Condiff
2003/0116577 A1 * 6/2003 Slongo ..... B65D 1/165 220/755
2003/0168460 A1 * 9/2003 von Holdt, Sr. ..... B65D 1/12 220/659
2006/0175340 A1 * 8/2006 Garone ..... B65D 25/2802 220/772
2006/0243736 A1 * 11/2006 Kline ..... B44D 3/128 220/780
2007/0084870 A1 * 4/2007 Luburic ..... B65D 1/16 220/634
2007/0119854 A1 * 5/2007 Rittmann ..... B44D 3/121 220/570
2009/0032542 A1 * 2/2009 Temple ..... B65D 25/32 220/669
2009/0266738 A1 * 10/2009 Dunford ..... B65D 21/0233 206/515
2011/0163107 A1 * 7/2011 Saunders ..... B01F 7/0035 220/694
2013/0116577 A1 5/2013 Yazicioglu et al.
2014/0027454 A1 * 1/2014 Banik ..... B65F 1/16 220/212.5
2014/0076893 A1 * 3/2014 Cheek ..... A47L 13/52 220/200
2014/0097586 A1 * 4/2014 Enguita ..... B44D 3/12 280/79.2
2014/0327258 A1 * 11/2014 Ring ..... B65D 25/2808 294/31.2
2014/0374425 A1 * 12/2014 Duckett ..... B44D 3/14 220/606
2015/0225124 A1 * 8/2015 Persson ..... B65D 25/2885 222/475
2015/0321796 A1 11/2015 O'Leary et al.
2015/0360818 A1 * 12/2015 Condiff ..... B65D 25/2897 220/608

* cited by examiner

CONTAINER WITH INTEGRATED HANDLES

CROSS REFERENCES TO RELATED APPLICATIONS

This application is related to and incorporates by reference herein U.S. Design patent application No. 29/521,979, entitled "CONTAINER WITH INTEGRATED HANDLES", filed on Mar. 26, 2015, the disclosure of which is incorporated by reference as if the same were fully set forth herein.

TECHNICAL FIELD

This disclosure relates generally to containers for transporting goods and materials, including consumer goods.

BACKGROUND

There are many industrial containers in usage today. These containers may be used for the containment and shipping of various substances including, but not limited to, food, paints, oils, consumer goods, construction materials, inks, chemicals, lubricants, adhesives, coatings, roofing mastics, driveway sealers, flavorings, sanitation supplies, building products, ice melt compounds, powders, pet food, and other materials. Such containers may come in a variety of sizes and may hold various amounts of material, including, in some cases, four or more gallons. Further, these containers may include a carrying handle that may be shipped separately and attached to the sides of the container to aid in carrying and dispensing the contents of the container.

The containers mentioned above may be convenient for shipping and storing goods, but may prove difficult for use by the end user. For example, even with a carrying handle, it may be difficult for a consumer to pour or control a four gallon bucket of pet food due to the weight of the container and the material. Further, when handles are included with containers to assist an end user with pouring or controlling a container, these handles may interfere with one another when multiple containers are optimally arranged for shipment (e.g., on a pallet or the like).

SUMMARY

According to particular embodiments, a container including a) a bottom; b) a sidewall, wherein an upper portion of the sidewall defines an opening; c) a bumper assembly, projecting outwardly from the sidewall below the upper portion; d) at least one upper handle projecting outwardly from the bumper assembly, the at least one upper handle defines a void between the handle and the sidewall; and e) at least one lower hand-grip comprising a cavity extending inwardly.

In various embodiments, a container including: a) a substantially rectangular bottom; b) a sidewall extending upwardly from the bottom and defining an opening; and c) at least one lower hand-grip proximate the substantially rectangular bottom formed by the sidewall comprising a lower handle and a lower cavity, wherein the lower cavity perimeter extends inwardly from the sidewall into the opening.

In some embodiments, a rectangular container for storing, carrying, or transporting materials, the rectangular container including: a) a substantially rectangular bottom; b) a sidewall extending upwardly from the rectangular bottom, wherein: i) an upper portion of the sidewall defines an opening; and ii) a lower portion of the sidewall defines at least one cavity extending inwardly from the sidewall and a lower hand-grip within the cavity; and c) a bumper assembly extending in a substantially perpendicular direction from the sidewall and comprising a bail ear for attaching a handle, a right upper handle located at a first particular distance from the upper portion of the sidewall, and a left upper handle located at a second particular distance from the upper portion of the sidewall, wherein the first particular distance is a greater distance from the upper portion of the sidewall than the second particular distance.

BRIEF DESCRIPTION OF THE DRAWINGS

Further features and benefits of the present disclosure will be apparent from a detailed description of various embodiments thereof taken in conjunction with the following drawings, wherein similar elements are referred to with similar reference numbers, and wherein.

DETAILED DESCRIPTION

The above and further features of the disclosed exemplary container will be recognized from the following detailed descriptions and drawings of particular embodiments. In various embodiments, a container with upper and lower handles that minimize conflict or interference with adjacent containers is disclosed. In particular embodiments, the container includes a bumper assembly, upper handles (which may or may not be vertically off-set) and one or more lower hand-grips. In further embodiments, the container includes one or more lower hand-grips and no upper handles. According to at least one embodiment, the container is substantially rectangular in shape. In one or more embodiments, the container is substantially circular in shape.

The container discussed herein may be formed in any suitable way. In various embodiments, the container is formed by injection molding. In particular embodiments, the container is 3D printed or created via other additive manufacturing means. In further embodiments, various components of the container are formed or created separately and the various components of the container are joined or otherwise suitably connected to form the container.

As will be understood by one of ordinary skill in the art, the container discussed herein may be used for storing or transporting any variety of materials, including, but not limited to: food, paints, oils, consumer goods, construction materials, inks, chemicals, lubricants, adhesives, coatings, roofing mastics, driveway sealers, flavorings, sanitation supplies, building products, ice melt compounds, powders, pet food, and other such materials. The container may be formed from any suitable material or materials for storing or transporting such materials. In various embodiments, the container is manufactured from plastic (e.g., polyethylene, high-density polyethylene, etc.). In particular embodiments, the container is manufactured from a metal or composite material.

Such an exemplary container may provide a number of uses. In embodiments that include upper handles, the upper handles may assist a user or users (e.g., one user on each side of the container) in lifting the container into or out of a shopping cart or car trunk, onto or off of a shelf, etc. In embodiments that include lower hand-grips, which, in some embodiments, are ergonomically designed, a user may more easily pour the contents of the container.

Figure 1:
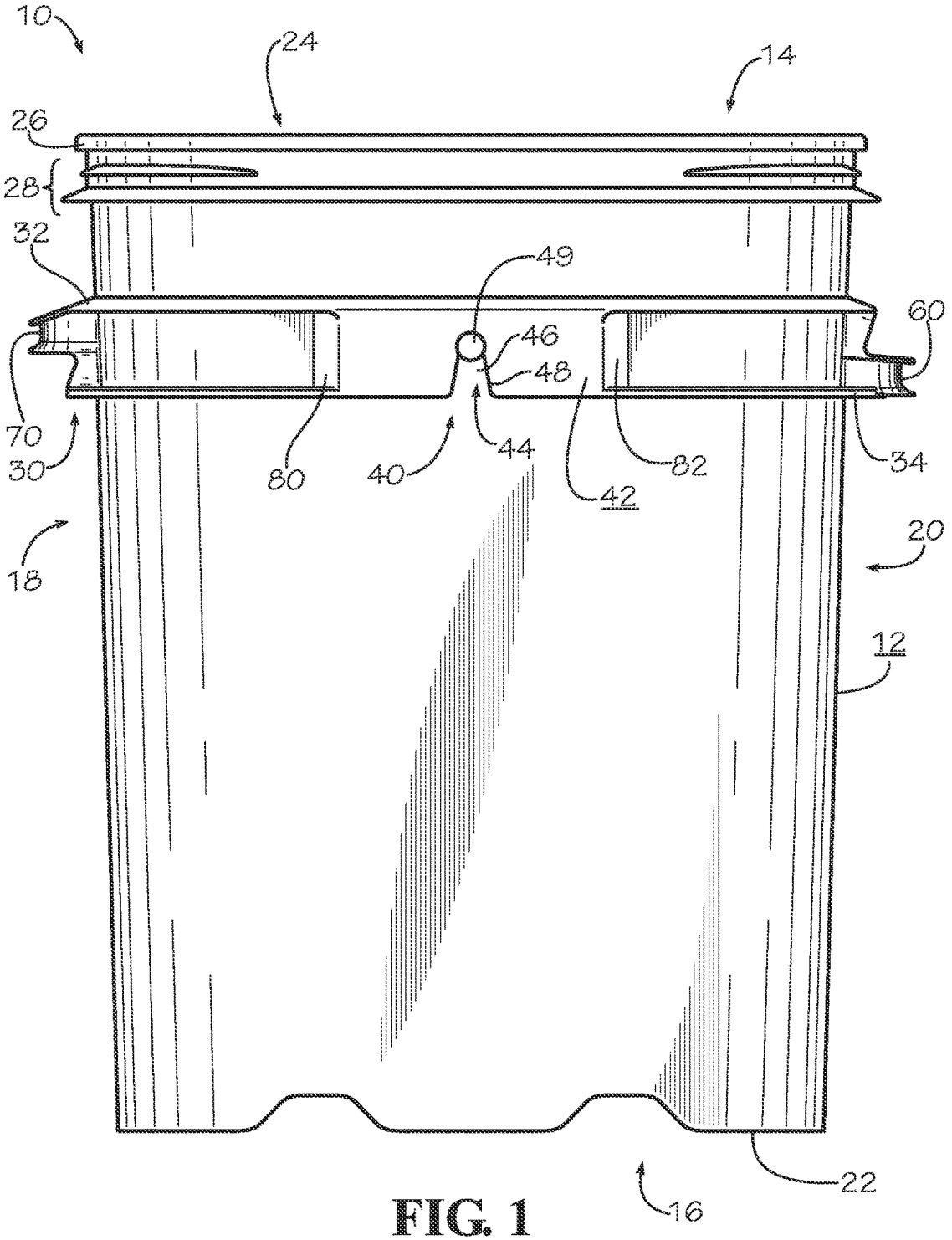
FIG. 1 is front view of an exemplary container, according to one embodiment of the present disclosure.

Turning now to an exemplary container illustrated in the figures, FIG. 1 depicts a front-view of an exemplary container 10, according to one embodiment. In the embodiment shown in FIG. 1, the exemplary container includes a container body 12 with a proximal end 14 (top), a distal end 16 (bottom), a left side 18, and a right side 20. In the embodiment shown, the exemplary container 10 includes a bottom 22 approximate the distal end 16 for sealing the exemplary container and defining an interior cavity. The exemplary container 10, in particular embodiments, includes an opening 24 near the proximal end 14.

In various embodiments, the exemplary container 10 includes various features near the proximal end 14. In particular embodiments, the exemplary container 10 includes an angled bead 26 for interlocking or attaching a cover or lid near the proximal end 14. In some embodiments, the exemplary container 10 includes one or more satellite rings 28, located and generally formed near the proximal end of the body 12. In particular embodiments, the one or more satellite rings extend fully or partially around the body 12 of the exemplary container 10.

According to at least one embodiment, the exemplary container 10 includes a bumper assembly 30. The bumper assembly 30, in particular embodiments, includes an upper bumper satellite ring 32, a lower bumper satellite ring 34, an upper left handle 60 (left side 18), an upper right handle 70 (right side 20), and one or more bail ear assemblies 40 formed between the upper bumper satellite ring 32 and the lower bumper satellite ring 34. As will be understood by one of ordinary skill in the art, the bumper assembly 30 may include more than two satellite rings (or less than two satellite rings) in particular embodiments.

The upper bumper satellite ring 32 and the lower bumper satellite ring 34 may generally be for protecting the container 10 when it comes in contact with another object. Further, the upper bumper satellite ring 32 and the lower bumper satellite ring 34 form the upper left handle 70 (more particularly described below in relation to FIG. 3), the upper right handle 60 (more particularly described below in relation to FIG. 2) and the bail ear assembly 40. As shown in FIG. 1, the upper left handle 70 and the upper right handle 60 are not at the same vertical location. In this embodiment (and others), these handles are offset from each other such that when two containers are placed next to each other (nested) they can be very close together without the upper handles conflicting. In this way, in this embodiment, more containers with this handle configuration can fit in a smaller space (e.g., because the container can be placed closer together).

As shown in the embodiment of FIG. 1, the bail ear assembly 40 includes a vertical support 42 parallel to an external wall of the body 12. The vertical support 42, in various embodiments, defines an opening 44 that includes a channel portion 46 that tapers from a mouth area 48 and opens into a generally semi-circular seating portion 49. The bail ear assembly 40, in particular embodiments, includes two vertical support structures 80 and 82 that are generally perpendicular to the external sidewall of the body 12. As will be understood by one of ordinary skill in the art, in at least one embodiment, the vertical support 42 and the external wall of the body 12 may not be directly in contact (e.g., such that a handle may be affixed to the bail ear assembly 40). In further embodiments, the bail ear assembly 40 includes internal vertical supports perpendicular to the external wall of the body 12 for supporting the bail ear assembly 40 (not shown in FIG. 1).

Figure 2:
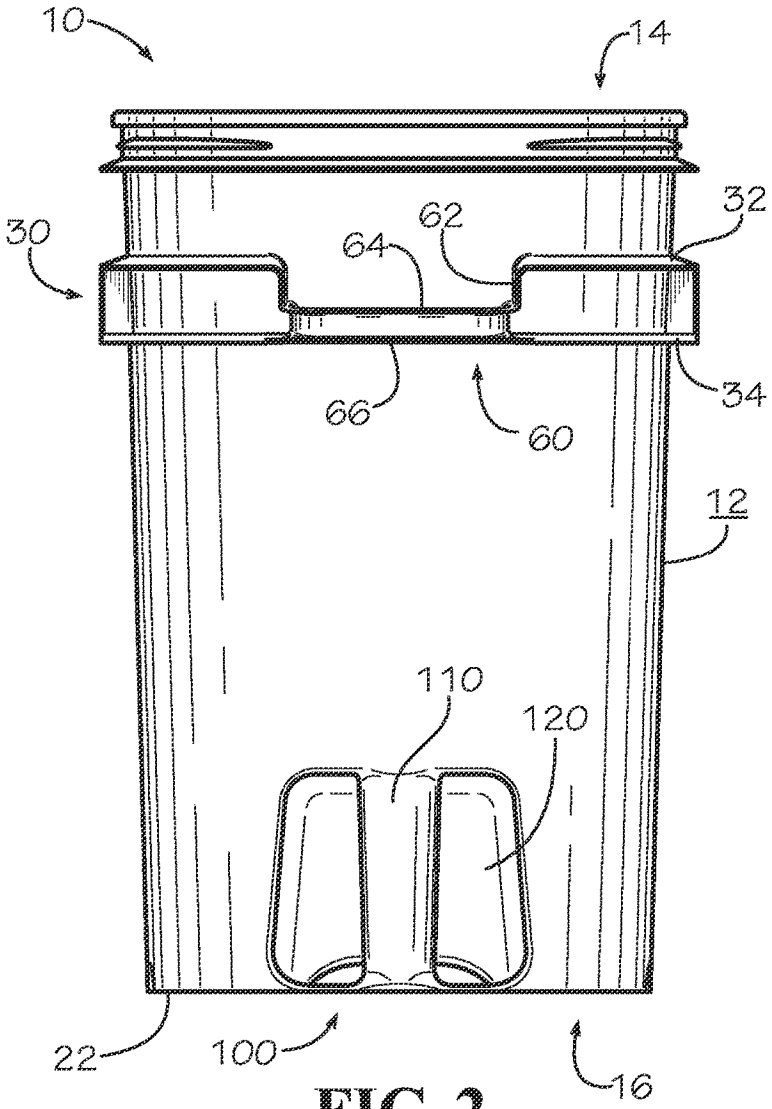
FIG. 2 is a side view of the exemplary container of FIG. 1, according to one embodiment of the present disclosure.

Turning now to FIG. 2, a right side view of the exemplary container 10 of FIG. 1 is depicted. The embodiment shown in FIG. 2 includes the right handle 60, as shown in FIG. 1. In particular embodiments, the right handle 60 is formed such that a consumer can grip the right handle 60 to assist in lifting exemplary container 10 and/or pouring the contents of the exemplary container 10. Thus, many configurations of the right handle 60 are contemplated, but not necessarily shown. In at least one particular embodiment, the right handle 60 may be knob-shaped, angled in an upward direction (e.g., toward the proximal end 14), hook or scoop-shaped, etc.

In a particular embodiment, the right handle 60 is formed between the upper bumper satellite ring 32 and the lower bumper satellite ring 34. In particular embodiments, the upper satellite ring 32 forms a downward slope 62 and an upper surface 64 of the right handle 60 and the lower satellite ring 34 forms a lower surface 66 of the right handle 60. In one embodiment, the slope 62 is formed such that a handle from another container (e.g., a container similar to exemplary container 10, with a left handle) "interlocks" or allows a lower surface of the handle from the other container to slide above the upper surface 64 of right handle 60.

As will be understood by one of ordinary skill in the art, the right handle 60 may be formed in any suitable way, including by injection molding. As will also be understood by one of ordinary skill in the art, the right handle 60 may be formed as an integral part of the exemplary container 10 or may be formed separately and attached to the external sidewall of body 12 by any suitable means, including, but not limited to: by an adhesive, by friction welding, by mechanical fasteners (nails, screws, etc.), etc.

The embodiment shown in FIG. 2 further includes a lower right hand-grip assembly 100. The lower right hand-grip assembly 100 includes a lower right hand-grip 110 and a lower right hand cavity 120. The lower right hand-grip assembly 100 may be used in conjunction with the upper right handle 60 in a lever-type motion to lift the exemplary container 10 or pour its contents (e.g., a consumer may lift the distal end 16 of the exemplary container 16 to assist in pouring the contents of the exemplary container 10). In one embodiment, the lower right hand-grip assembly is substantially similar to the lower left hand grip assembly 200, which is further discussed below in relation to FIGS. 3-5.

Figure 3:
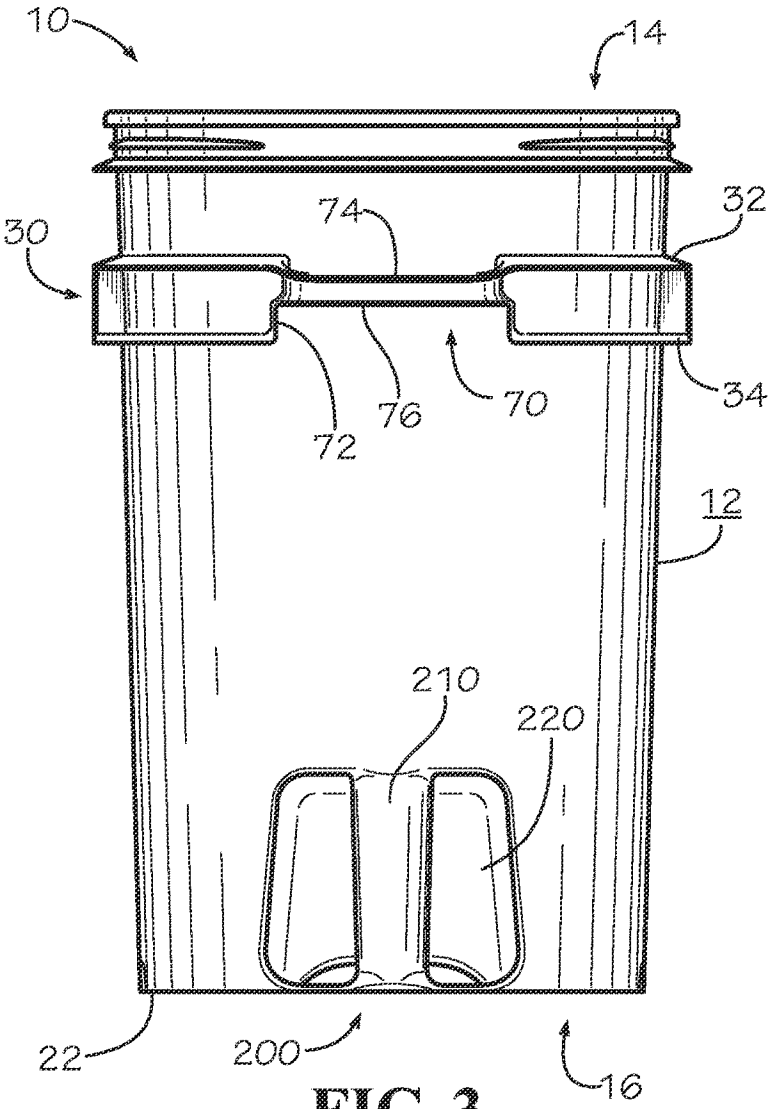
FIG. 3 is a side view of the exemplary container of FIG. 1, according to one embodiment of the present disclosure.

Turning now to FIG. 3, a left side view of the exemplary container 10 of FIG. 1 is depicted. The embodiment shown in FIG. 3 includes the left handle 70, as shown in FIG. 1. In particular embodiments, the left handle 70 is formed such that a consumer can grip the left handle 70 to assist in lifting the exemplary container 10 and/or pouring the contents of the exemplary container 10. Thus, many configurations of the left handle 70 are contemplated, but not necessarily shown. In at least one particular embodiment, the left handle 70 may be knob-shaped, angled in an upward direction (e.g., toward the proximal end 14), hook or scoop-shaped, etc.

In a particular embodiment, the left handle 70 is formed between the upper bumper satellite ring 32 and the lower bumper satellite ring 34. In particular embodiments, the lower satellite ring 34 forms an upward slope 72 and an lower surface 76 of the left handle 70 and the upper satellite ring 32 forms an upper surface 74 of the left handle 70. In one embodiment, the slope 72 is formed such that a handle from another container (e.g., a container similar to exemplary container 10, with a similar right handle) "interlocks" or allows an upper surface of the handle from the other container to slide below the lower surface 764 of left handle 70.

As will be understood by one of ordinary skill in the art, the left handle 70 may be formed in any suitable way, including by injection molding. As will also be understood by one of ordinary skill in the art, the left handle 70 may be formed as an integral part of the exemplary container 10 or may be formed separately and attached to the external sidewall of body 12 by any suitable means, including, but not limited to: by an adhesive, by friction welding, by mechanical fasteners (nails, screws, etc.), etc.

The embodiment shown in FIG. 3 further includes a lower left hand-grip assembly 200. The lower left hand-grip assembly 200 includes a lower left hand-grip 210 and a lower left hand cavity 220. The lower left hand-grip assembly 200 may be used in conjunction with the upper left handle 70 to lift the exemplary container 10 or pour its contents (e.g., a consumer may lift the distal end 16 of the exemplary container 10 to assist in pouring the contents of the exemplary container 10). An exemplary embodiment of the lower left hand-grip assembly 200 is further discussed below in relation to FIGS. 4 and 5.

Figure 5:
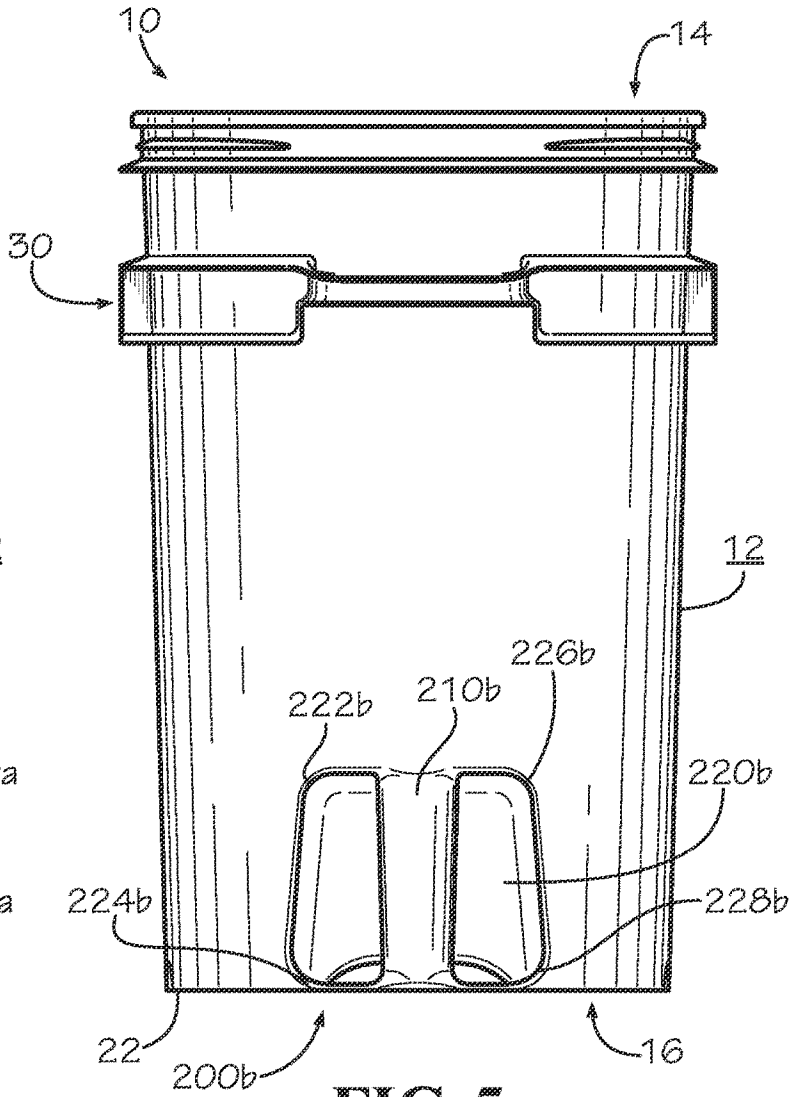
FIG. 5 is a side view of a second alternate exemplary container, according to one embodiment of the present disclosure.
Figure 4:
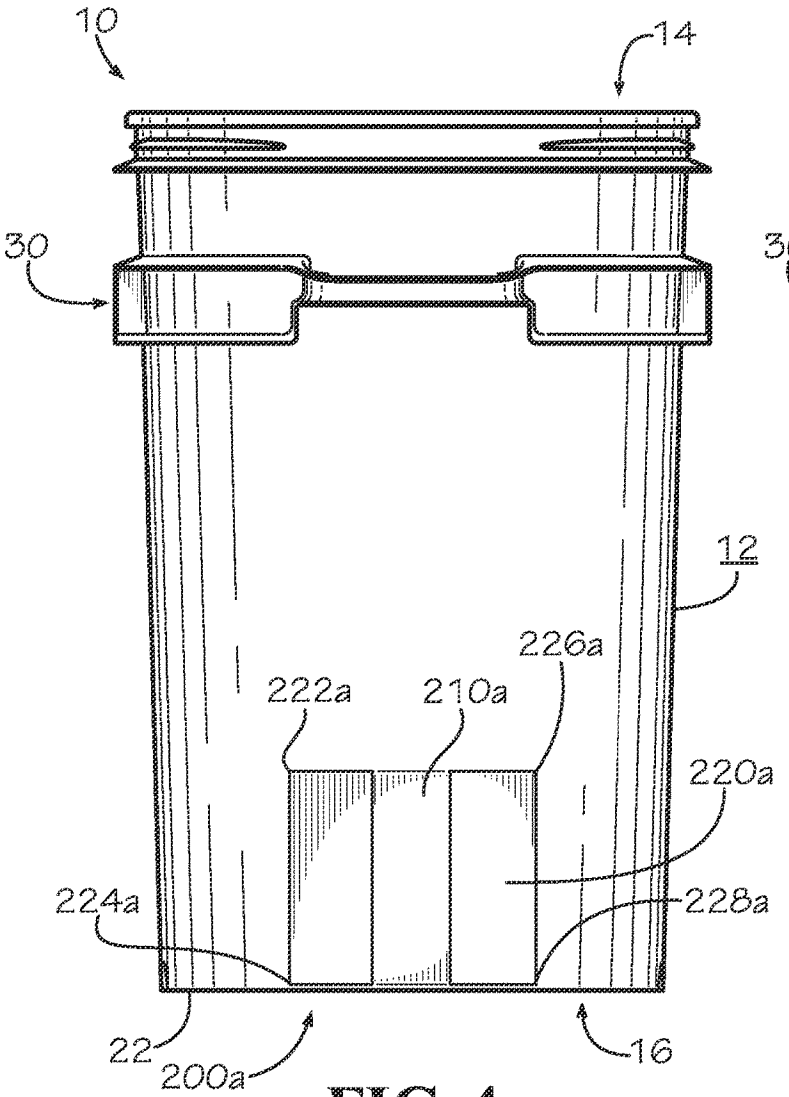
FIG. 4 is a side view of an alternate exemplary container, according to one embodiment of the present disclosure.
Figure 6:
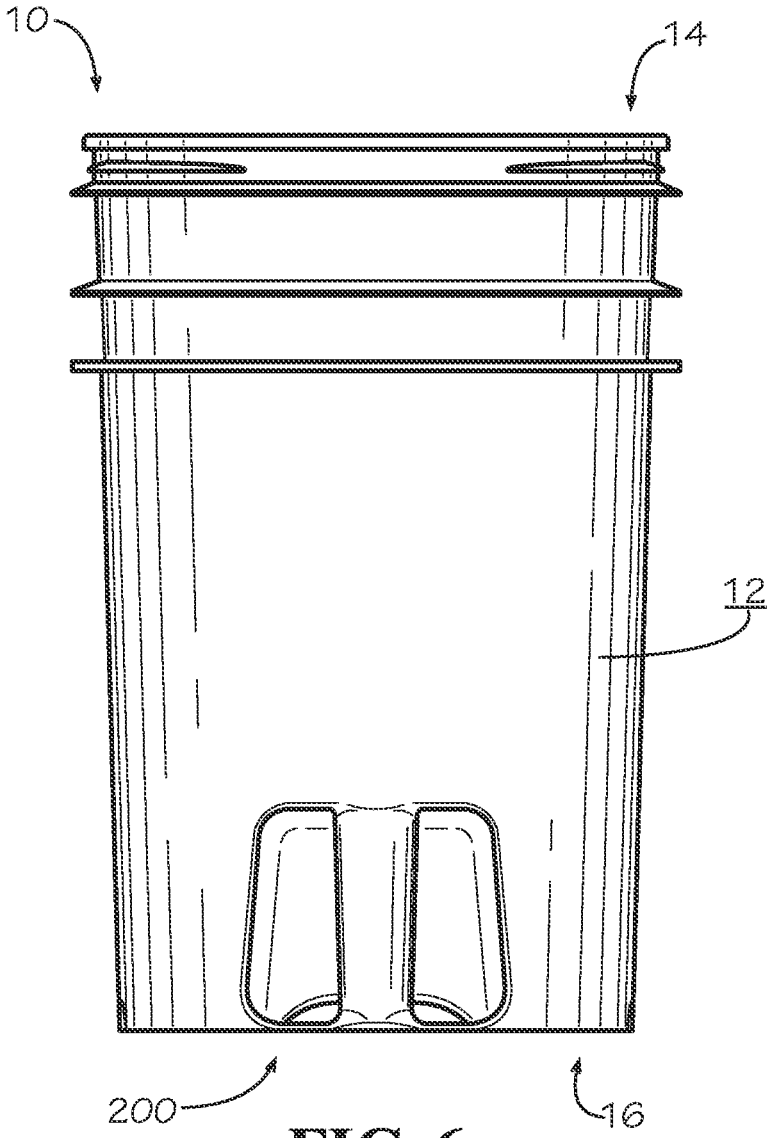
FIG. 6 is a side view of a third alternate exemplary container, according to one embodiment of the present disclosure.

FIGS. 4, 5, and 6 show alternate embodiments of the left side 18 of the exemplary container 10 of FIG. 1. Particularly, FIGS. 4 and 5 show alternate embodiments of the lower left hand-grip assemblies 200*a* and 200*b*, respectively, and FIG. 6 shows an embodiment of the left side 18 of the exemplary container 10 of FIG. 1 without a bumper and upper handle. As will be understood by one of ordinary skill in the art, these alternate embodiments are shown for the left side 18 of the exemplary container 10 of FIG. 1, but substantially similar embodiments are contemplated for the right side 20 of the exemplary container 10 of FIG. 1.

For example, in a particular embodiment, the right side 20 of the exemplary container 10 of FIG. 1 may include alternate embodiments of the lower right hand-grip assembly 100 substantially similar to the alternate embodiments of the lower left hand-grip assembly 200 (as shown in FIGS. 4 and 5). Further, the right side 20 of the exemplary container 10 of FIG. 1 may not include a bumper and upper handle as shown for the left side 18, as shown in FIG. 6. For simplicity and brevity, these alternate embodiments are discussed for the left side only.

Turning now to the embodiment shown in FIG. 4, the body 12 of the exemplary container 10 defines a lower left hand-grip assembly 200*a*. The lower left hand-grip assembly 200*a* includes a lower hand-grip 210*a* and a cavity 220*a*. The lower hand-grip 210*a*, in the embodiment shown, is a substantially circular hand-grip extending vertically from near the distal end 16 of the exemplary container 10. Continuing with the embodiment shown, the lower hand-grip 210*a* is substantially the same diameter for its entire length. In various embodiments, the lower hand-grip 210*a* is formed such that a user or consumer can wrap their hand around at least a portion of the hand-grip 210*a* to assist in lifting and controlling the exemplary container 10 when pouring its contents.

To enable an end-user or consumer to wrap their hand around at least a portion of the hand-grip 210*a*, the cavity 220*a*, in the embodiment shown, is a cavity that extends toward the interior of the exemplary container 10 (e.g., around and at least partially behind the hand-grip 210*a*). As shown in the embodiment in FIG. 4, the body 12 forms the opening to the cavity 220*a* with angles that are substantially 90 degrees. Particularly, the angles 222*a*, 224*a*, 226*a*, and 228*a* are substantially 90 degrees.

Turning now to the embodiment shown in FIG. 5, the body 12 of the exemplary container 10 defines a lower left hand-grip assembly 200*b* (e.g., the lower left hand-grip assembly 200*b* is substantially similar to the lower hand-grip assembly 200 shown in FIG. 3). The lower left hand-grip assembly 200*b* may be ergonomically designed or optimized for an end-user or consumer to hold. The lower left hand-grip assembly 200*b* includes a hand-grip 210*b* and a cavity 220*b*. The lower hand-grip 210*b*, in the embodiment shown, is a substantially circular hand-grip extending vertically from near the distal end 16 of the exemplary container 10. Continuing with the embodiment shown, the lower hand-grip 210*b* varies in diameter along its vertical length (e.g., for ergonomics or other reasons). In the embodiment shown in FIG. 5, the lower hand-grip 210*b* decreases in diameter from the top of the lower hand-grip 210*b* (e.g., the part of the lower hand-grip nearest the proximal end 14 of the exemplary container 10) to the bottom of the lower hand-grip 210*a* (the part of the lower hand-grip nearest the distal end 16 of the exemplary container 10). In various embodiments, the lower hand-grip 210*b* is formed such that a user or consumer can wrap their hand around at least a portion of the hand-grip 210*b* to assist in lifting and controlling the exemplary container 10 when pouring its contents. In particular embodiments, the lower hand-grip 210*a* does not protrude past the body sidewall 12 so that it does not interfere with other containers when shipped or nested. In further embodiments, the lower hand-grip 210*a* may have other features to assist an end-user or consumer with lifting the exemplary container 10, such as, for example, the lower hand-grip 210*a* may be relatively hefty, made of durable material, reinforced at points where it is connected to the rest of exemplary container 10, and/or include non-slip grooves (or other surface finishes), divots for fingers, etc.

To enable an end-user or consumer to wrap their hand around at least a portion of the hand-grip 210*b*, the cavity 220*b*, in the embodiment shown, is a cavity that extends toward the interior of exemplary container 10 (e.g., around and at least partially behind hand-grip 210*b*). As shown in the embodiment in FIG. 6, the body 12 forms a substantially rectangular opening to the cavity 220*b* with angles that are substantially other than 90 degrees. Particularly, the angles 222*b*, 224*b*, 226*b*, and 228*b* may each be any suitable angles such as between about 60 and 120 degrees. For example, the angles 226*b* and 228*b* may be 95 degrees and 85 degrees, respectively. Further, the opening to the cavity 220*b* may form arcs of any suitable length, opposed to substantially square corners (e.g., at 222*b*, 224*b*, 226*b*, and 228*b*).

Turning now to the embodiment shown in FIG. 6, an embodiment of the left side of the exemplary container 10 of FIG. 1, including a lower left hand-grip assembly 200 (e.g., lower left hand-grip assembly 200*a* or 200*b*) is shown. In the embodiment shown in FIG. 6, the exemplary container 10 excludes an upper handle. In various embodiments, the exemplary container 10 may include a bumper assembly (e.g., bumper assembly 30) with no handle. In further embodiments, the exemplary container 10 may not include a bumper assembly.

Figure 7:
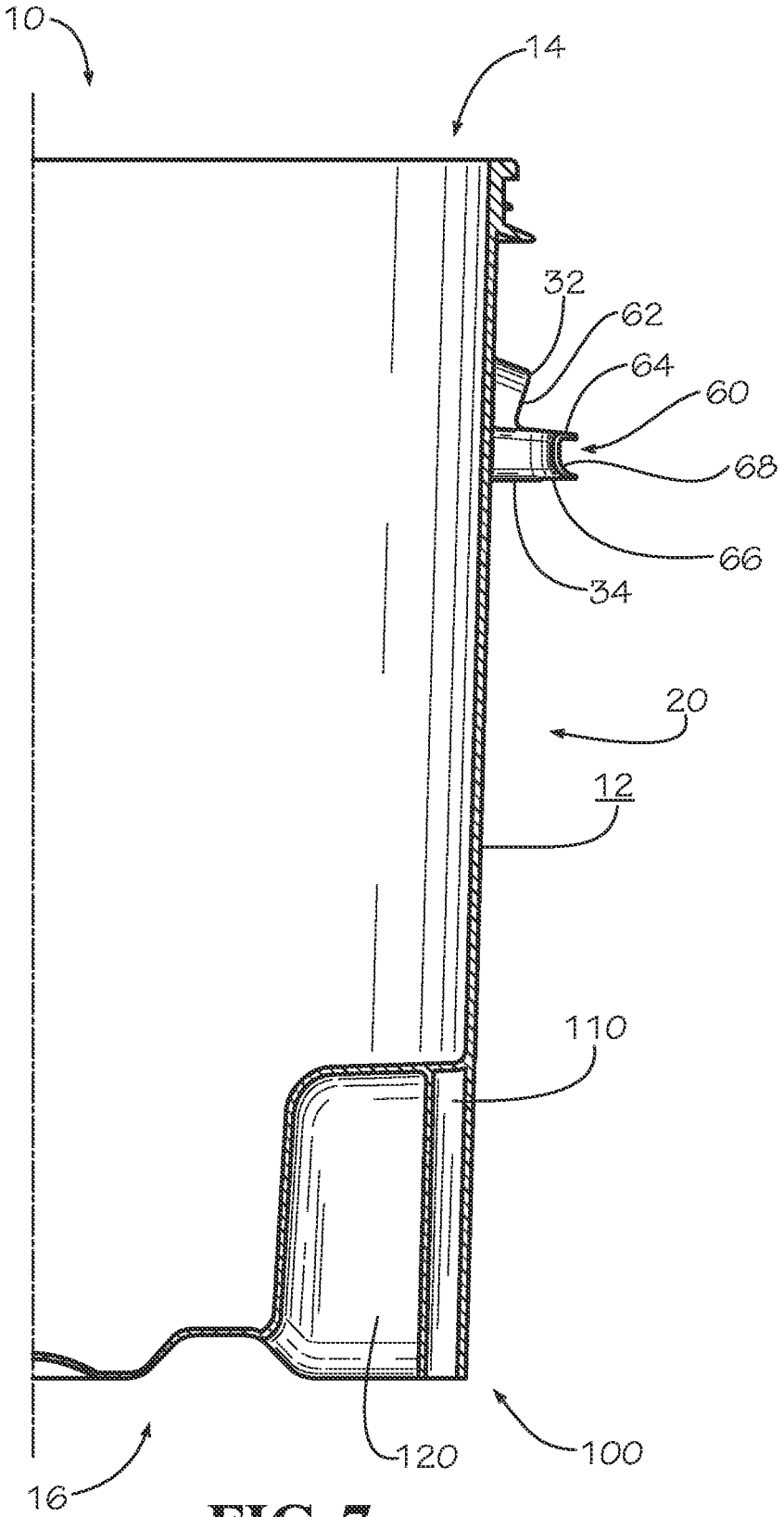
FIG. 7 is a partial cross-sectional view of the exemplary container of FIG. 1, according to one embodiment of the present disclosure.

FIG. 7 depicts a cross-section of the exemplary container 10 of FIG. 1 through the center of the right handle 60 and a vertical axis of lower right hand-grip 110. As will be understood by one of ordinary skill in the art, the embodiments, features, and dimensions are shown and discussed for the right side 20 of the exemplary container 10 of FIG. 1, but substantially similar embodiments, features, and dimensions are contemplated for the left side 18 of the exemplary container 10 of FIG. 1. For simplicity and brevity, these embodiments, features, and dimensions are discussed for the right side 20 only.

Continuing with the embodiment shown in FIG. 7, the upper right handle 60 generally slopes downward toward the distal end 16 of the exemplary container 10. Further, in the embodiment shown in FIG. 7, the upper right handle 60 is formed by the upper satellite ring 32 and the lower satellite ring 34. In various embodiments, the upper satellite ring 32 forms a slope 62 that slopes downward to the upper surface 64 of the upper right handle 60. The upper surface 64 and the lower surface 66 of the upper right handle 60, in various embodiments, creates a substantially c-shaped channel 68, the center of which is substantially parallel to at least a portion of the sidewall 12.

As shown in FIG. 7, the lower right hand-grip assembly 100 includes the lower right hand-grip 110 and the lower right-hand cavity 120. In various embodiments, as shown in FIG. 7, the lower right hand-grip 110 is substantially the same diameter from a top of the lower right hand-grip 110 (e.g. the portion of lower right hand-grip closest to the proximal end 14 of the exemplary container 10) to the bottom of lower right hand-grip 110 (e.g., the portion of lower right hand-grip 110 closest to the distal end 16 of the exemplary container 10) along the axis shown. As will be understood by one of ordinary skill in the art, in particular embodiments, the lower right hand-grip 110 may vary in diameter along this axis. As shown in FIG. 7, the lower right hand-grip 110, other than an exterior surface, is substantially within the lower right cavity 120.

According to particular embodiments, the lower right cavity 120 extends inwardly from the external side wall of body 12. As will be understood by one of ordinary skill in the art, the lower right cavity 120 may extend any suitable amount inwardly to accommodate a consumer's hand or part of a consumer's hand for gripping the lower right hand-grip 110. In particular embodiments, the lower right cavity 120 may extend inwardly approximately one to five inches. In one embodiment, the lower right cavity 120 extends inwardly approximately three inches. In a further embodiment, the lower right cavity 120 extends inwardly about 0.5 to 6.0 inches. In at least one embodiment, the lower right cavity extends inwardly based on the size of the exemplary container 10. As a particular example, the lower right cavity 120 is larger if the exemplary container 10 is designed to hold four (4) gallons of a material than if the exemplary container 10 is designed to hold one (1) gallon of material.

The lower right cavity 120 may be any suitable shape. In a particular embodiment, the lower right cavity 120 may be substantially cubic shaped, rhomboid shaped, or other regular shape. In various embodiments, the lower right cavity 120 may be an irregular shape, extending from the sidewall (body) 12 inwardly behind the lower right hand-grip 110. In particular embodiments, the lower right cavity 120 may extend from the sidewall (body) 12 on a particular side of the lower right hand-grip 110 and at least partially behind the lower right hand-grip 110, but without a cavity opening on each side of the lower right hand-grip 110 (e.g., the lower right cavity 120 may be designed to accommodate only a portion of a user's hand so as to reduce the volume lost in the exemplary container 10).

Figure 8:
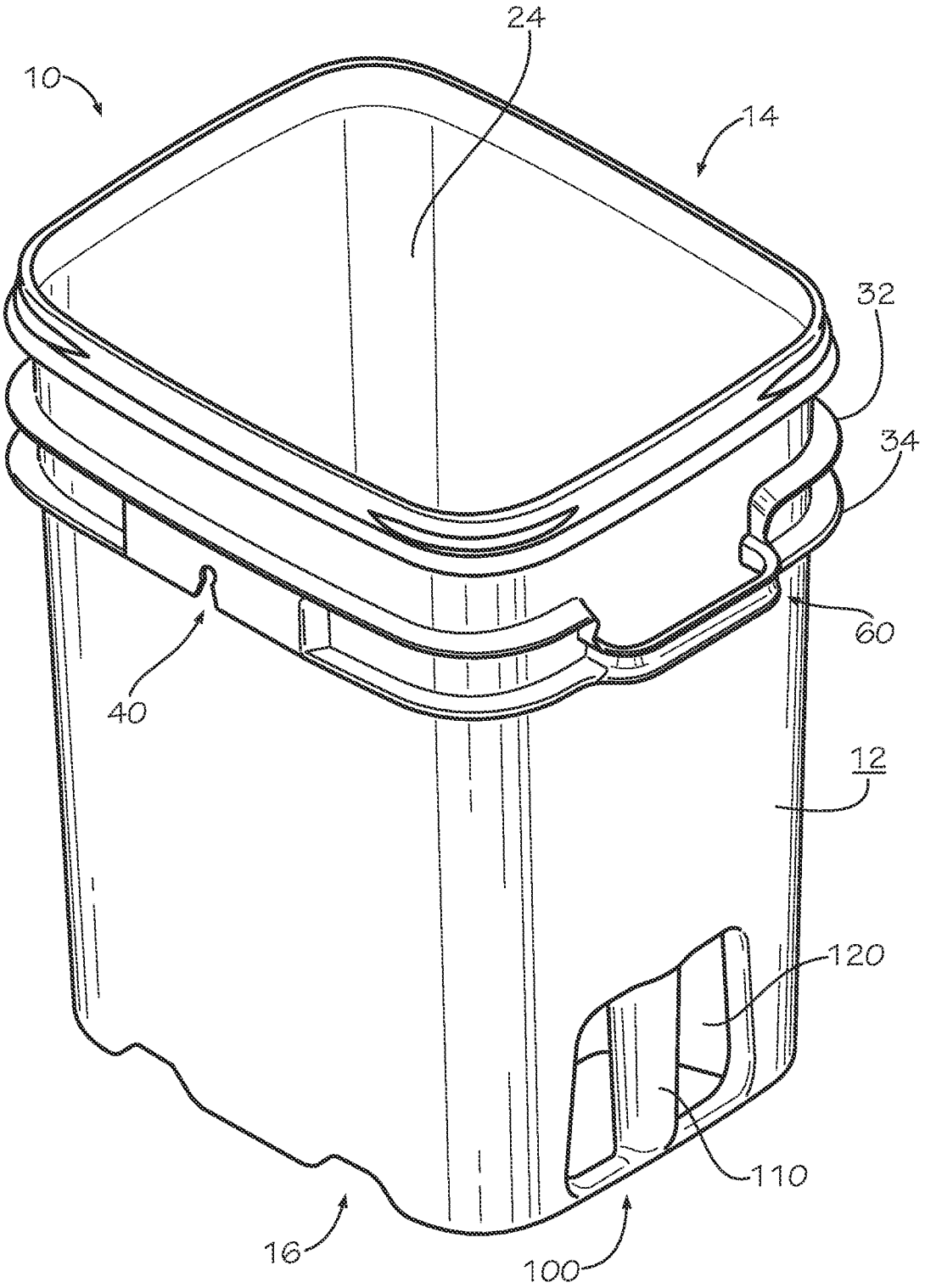
FIG. 8 is a first perspective view of the exemplary container of FIG. 1, according to one embodiment of the present disclosure.

FIG. 8 depicts a first perspective view of the exemplary container 10 of FIG. 1, according to one embodiment. In the embodiment shown, there is a void between the upper right handle 60 and the external sidewall of exemplary container 10 (e.g., sidewall of exemplary body 12). In particular embodiments, this void is sized such that a consumer can place part of their hand or some or all of their fingers between the upper right handle 60 and the external sidewall of the exemplary container 10.

Figure 9:
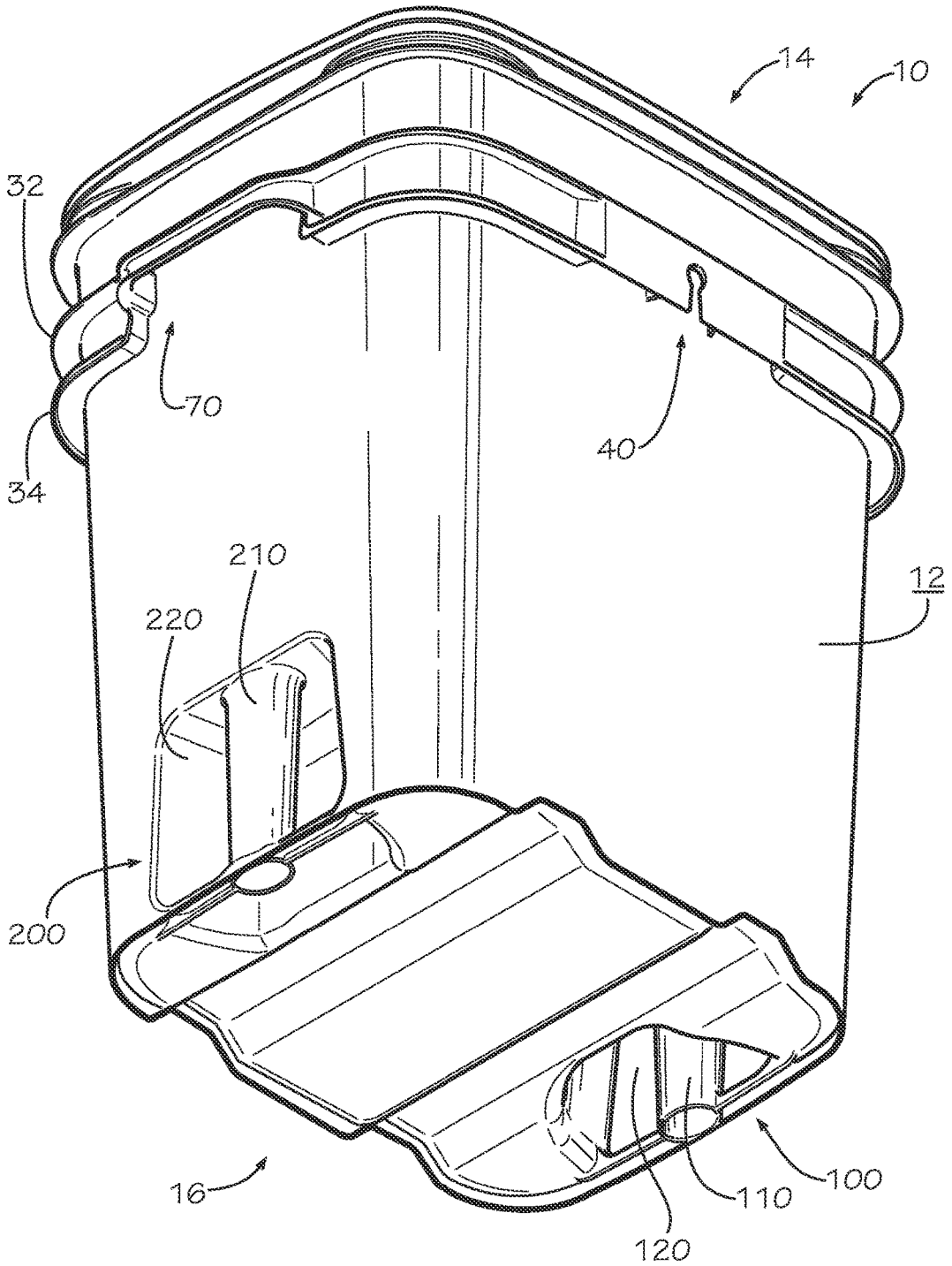
FIG. 9 is a second perspective view of the exemplary container of FIG. 1, according to one embodiment of the present disclosure.

FIG. 9 depicts a second perspective view of the exemplary container 10 of FIG. 1. As can be seen in this particular view, in various embodiments, the left hand cavity 220 and the right hand cavity 120 may extend through the bottom of the exemplary container 10. In an embodiment not shown, the left hand cavity 220 and the right hand cavity 120 may not extend through the bottom of the exemplary container 10. As further shown in the embodiment of FIG. 9, the lower left hand-grip 210 and the lower right hand-grip 110 may be generally oval in shape. As will be understood by one of ordinary skill in the art, the lower left hand-grip 210 and the lower right hand-grip 110 may be any suitable shape that enables a consumer to grab the handles.

Figure 10:
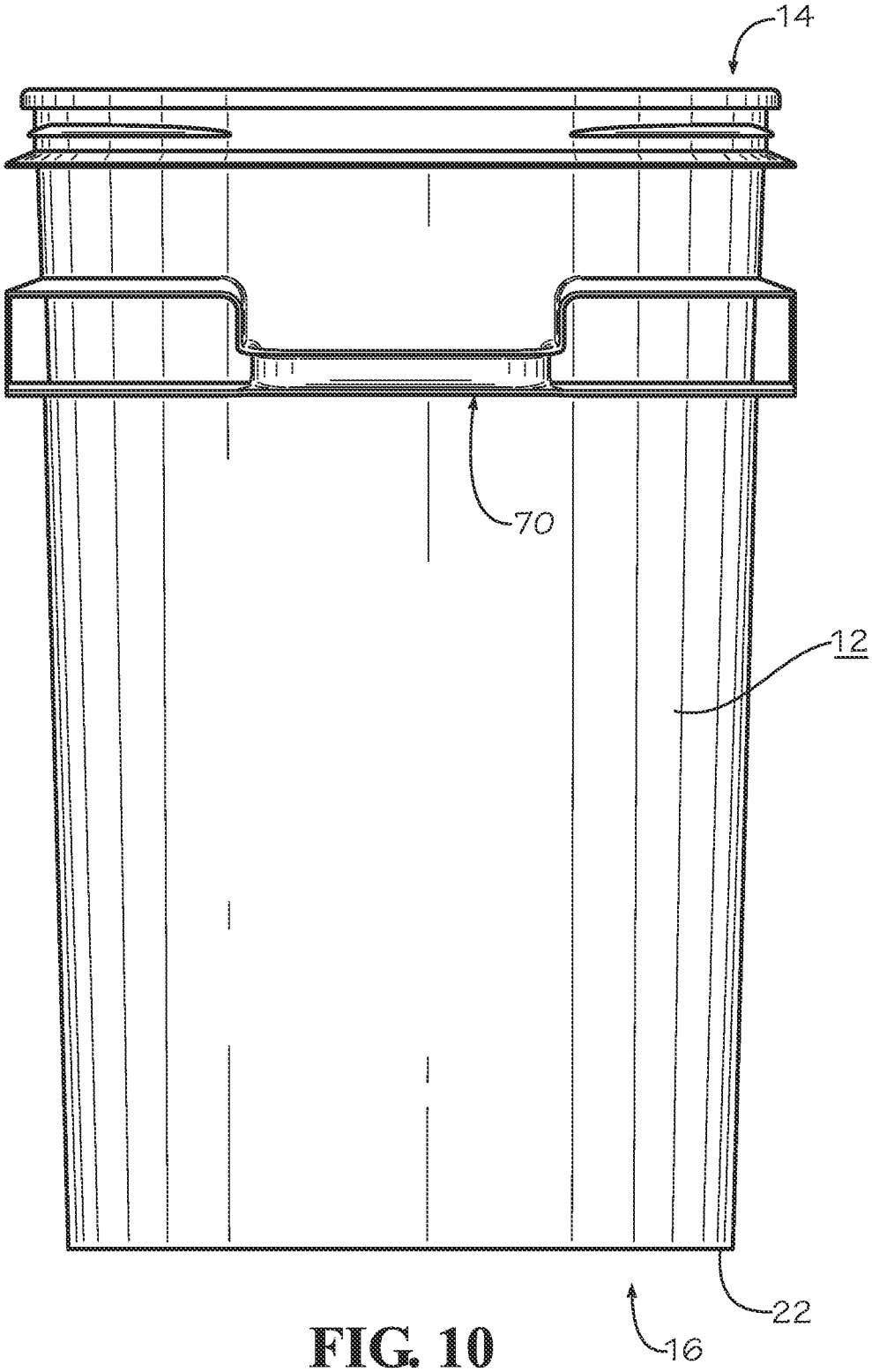
FIG. 10 is a side view of a fourth alternate exemplary container, according to one embodiment of the present disclosure.
Figure 12:
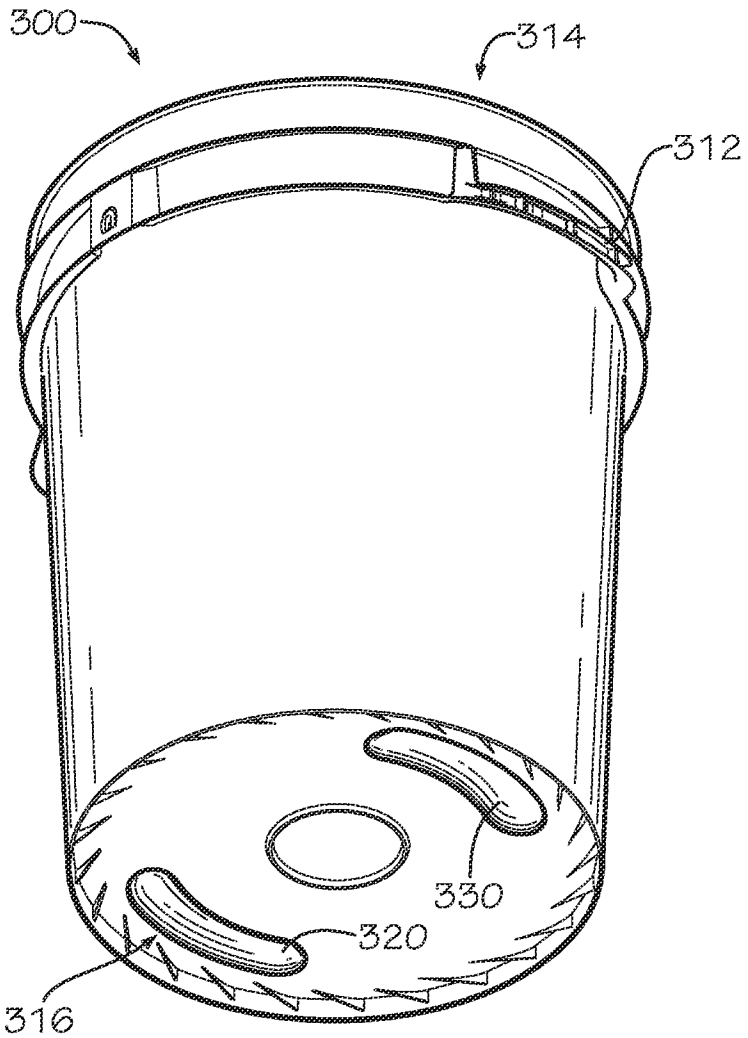
FIG. 12 is a perspective view of the exemplary circular container of FIG. 11, according to one embodiment of the present disclosure.
Figure 11:
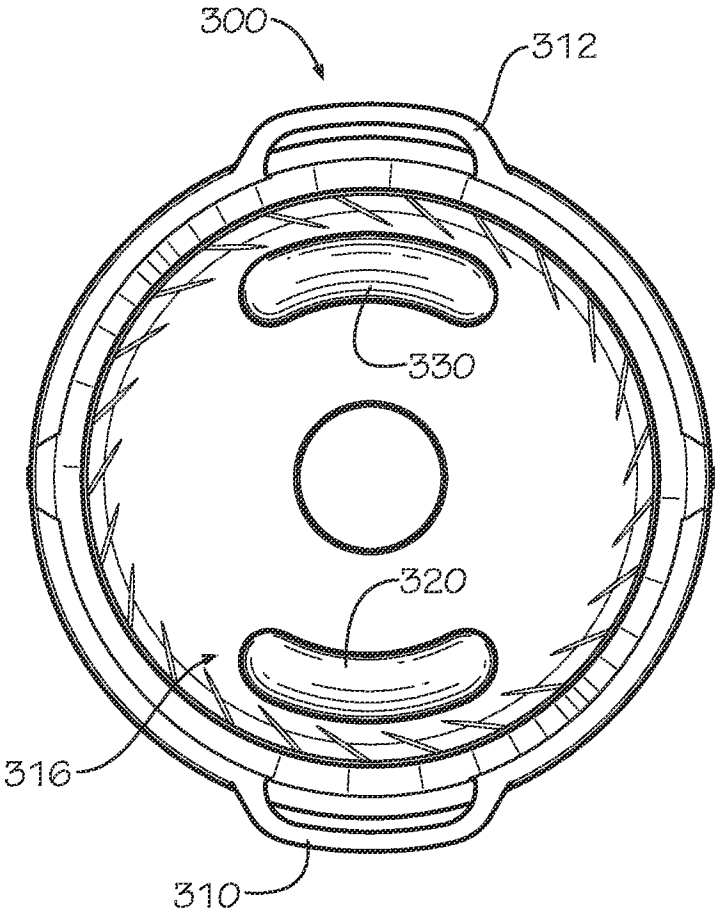
FIG. 11 is a bottom view of an exemplary circular container, according to one embodiment of the present disclosure.

FIGS. 10-12 depict further alternate embodiments of an exemplary container. FIG. 10 depicts an exemplary container with at least one upper handle (e.g., the upper right handle 60 or the upper left handle 70), but no lower hand-grip assemble (e.g., the lower right hand-grip assembly 100 or the lower left hand-grip assembly 200).

FIGS. 11-12 depict an exemplary container 300 that is circular in shape. In the particular embodiment shown, the exemplary container 300 has a proximal end (top) 314, a bottom surface 316, upper handles 310 and 312, and lower hand-grips 320 and 330. In various embodiments, the upper handles 310 and 312 are substantially similar to the upper handles as described in relation to the exemplary container 10 discussed regarding FIGS. 1-10. In at least one embodiment, the upper handles 310 and 312 are vertically offset similar to the way the upper right handle 60 and the upper left handle 70 are offset in particular embodiments of the exemplary container 10; e.g., an upper surface of the upper handle 310 is a first particular distance from the proximal end 314 of the exemplary container 300 and an upper surface of the upper handle 320 is a second particular distance from the proximal end 314 of the exemplary container 300 (the upper handles 310 and 312 are not shown as offset in FIGS. 11-12). In one or more embodiments, the upper surfaces of the upper handles 310 and 312 are substantially the same vertical distance from the proximal end 314 of the exemplary container 300.

In the embodiment shown in FIGS. 11 and 12, the exemplary container 300 includes the lower hand-grips 320 and 330. In various embodiments, each of the lower hand-grips 320 and 330 are semi-circular and extend from the bottom surface 316 of the exemplary container 300 toward an interior of the exemplary container 300. As will be understood by one of ordinary skill in the art, each of the lower hand-grips 320 and 330 may extend toward the interior of the exemplary container 300 any suitable distance for a consumer to pick up the bottom of the exemplary container 300 via one or more of the lower hand-grips 320 and 330 (e.g., each of the lower hand-grips 320 and 330 may extend toward the interior of exemplary container approximately 0.1 inches to 4 inches as measure from the bottom surface 316 to the point of the lower hand-grip that extends the furthest into the interior of the exemplary container 300.

The lower hand-grips 320 and 330 may be any suitable shape and in any suitable location. In a particular embodiment, as shown, the lower hand-grips 320 and 330 are semi-circular cavities formed by the bottom surface 316 of the exemplary container 300. In at least one embodiment, the lower hand-grips 320 and 330 are circular, rectangular, oval, triangular, obround, or any other suitable shape (not shown). In one or more embodiments, there is only a single lower hand-grip formed by the bottom surface 316 of the exemplary container 300 (this single lower hand-grip may be any suitable shape, such as semi-circular, circular, rectangular, oval, etc.).

CONCLUSION

Accordingly, it will be readily understood by those persons skilled in the art that, in view of the above detailed description of the various embodiments and articles of the present disclosure, the present disclosure is susceptible of broad utility and application. Many methods, embodiments, and adaptations of the present disclosure other than those herein described, as well as many variations, modifications, and equivalent arrangements will be apparent from or reasonably suggested by the present disclosure and the above detailed description thereof, without departing from the substance or scope of the present disclosure. Accordingly, while the present disclosure is described herein in detail in relation to various embodiments, it is to be understood that this detailed description is only illustrative and exemplary of the present disclosure and is made for purposes of providing a full and enabling disclosure of the present disclosure. The detailed description set forth herein is not intended nor is to be construed to limit the present disclosure or otherwise to exclude any such other embodiments, adaptations, variations, modifications, and equivalent arrangements of the present disclosure. The scope of the present disclosure is defined solely by the claims appended hereto and the equivalents thereof.

What is claimed is:

1. A container, comprising:

a bottom;

a sidewall, wherein an upper portion of the sidewall defines an opening and a portion of the sidewall adjacent to the bottom defines a cavity extending inwardly;

a bumper assembly, projecting outwardly from the sidewall below the upper portion, the bumper assembly comprising at least one satellite ring, the at least one satellite ring comprising an upper surface a first vertical distance from the upper portion of the sidewall;

a first upper handle projecting outwardly from the bumper assembly, the first upper handle defining a void between the first upper handle and the sidewall, wherein the upper surface of the at least one satellite ring slopes downwardly to form a top surface of the first upper handle and the top surface of the first upper handle is a second vertical distance from the upper portion of the sidewall;

a second upper handle projecting outwardly from the bumper assembly, the second upper handle defining a void between the second upper handle and the sidewall, wherein the upper surface of the at least one satellite ring forms a top surface of the second upper handle, the top surface of the second upper handle substantially co-planer with the upper surface of the at least one satellite ring; and at least one lower hand-grip encompassed by the cavity, the lower hand-grip extending from a location proximate the bottom of the container to a top portion of the cavity.

2. The container of claim 1, wherein:

the sidewall extends around a perimeter of the bottom; and the bumper assembly projects outwardly substantially along a perimeter of the sidewall, other than where the first and second upper handles define voids.

3. The container of claim 2, wherein the bumper assembly comprises a side portion affixed to the at least one satellite ring, wherein the side portion is substantially parallel to the sidewall and forms an opening for receiving a removable handle.

4. The container of claim 1, wherein a side surface of the first upper handle forms a channel that is substantially c-shaped.

5. The container of claim 1, wherein the cavity comprises:

an opening substantially planer to an exterior surface of the sidewall;

a top surface extending inwardly from the opening; and two substantially parallel side surfaces extending inwardly from the opening, wherein the at least one lower hand-grip extends from the top surface of the cavity substantially parallel to the two substantially parallel side surfaces downward to the bottom of the container.

6. The container of claim 5, wherein the at least one lower hand-grip comprises:

a central axis perpendicular to the bottom of the container; and an exterior surface, wherein no portion of the exterior surface extends beyond the exterior surface of the sidewall.

7. The container of claim 6, wherein:

the bottom of the container is substantially rectangular;

the sidewall has four sides; and the cavity opening is located on entirely on one of the four sides of the sidewall.

8. The container of claim 1, wherein the container further comprises an interior cavity defined by an interior surface of the sidewall, the interior cavity defining a volume of the container and wherein the volume of the container does not include a volume of the cavity.

9. The container of claim 1, wherein the at least one satellite ring integrally forms the first or second upper handle.

10. A rectangular container for storing, carrying, or transporting materials, the rectangular container comprising:

a substantially rectangular bottom;

an interior cavity defined by an interior surface of one or more sidewalls, the one or more sidewalls extending upwardly from the substantially rectangular bottom, wherein:

an upper portion of the one or more sidewalls define an opening for accessing the interior cavity; and a lower portion of at least one of the one or more sidewalls defines at least one cavity extending inwardly into the interior cavity from an exterior surface of the at least one of the one or more sidewalls, the at least one cavity comprising a top surface and two side surfaces;

a lower hand-grip circumscribed by the at least one cavity and extending perpendicular to the substantially rectangular bottom and substantially parallel to the two side surfaces of the at least one cavity and extending from the top surface of the at least one cavity downward to a location adjacent to the substantially rectangular bottom;

a void formed by the substantially rectangular bottom wherein the void extends through the substantially rectangular bottom into the at least one cavity circumscribing the lower hand-grip; and a bumper assembly extending in a substantially perpendicular direction from the sidewall and comprising a bail ear for attaching a handle, an upper satellite ring, a right upper handle comprising a top surface and located at a first particular distance from the upper portion of the sidewall, and a left upper handle comprising a top surface and located at a second particular distance from the upper portion of the sidewall, wherein:

an upper surface of the upper satellite ring forms the top surface of the right upper handle and the top surface of the left upper handle; and the first particular distance is a greater distance from the upper portion of the sidewall than the second particular distance.

11. The container of claim 10, wherein:

the at least one cavity is a first cavity; and the container comprises:

a second cavity extending inwardly from an exterior surface of a second sidewall of the one or more sidewalls, the second cavity comprising a top surface and two side surfaces; and a second lower hand-grip circumscribed by the second cavity and extending perpendicular to the substantially rectangular bottom and substantially parallel to the two side surfaces of the second cavity and extending from the top surface of the second cavity downward to a location adjacent to the substantially rectangular bottom.

12. A rectangular container for storing, carrying, or transporting materials, the rectangular container comprising:

a substantially rectangular bottom;

an interior cavity defined by an interior surface of one or more sidewalls, the one or more sidewalls extending upwardly from the substantially rectangular bottom, wherein an upper portion of the one or more sidewalls defines an opening for accessing the interior cavity;

an angled bead for attaching a lid near the upper portion of the one or more sidewalls;

a lower portion of at least one of the one or more sidewalls and the substantially rectangular bottom defining at least one cavity, the at least one cavity extending through the substantially rectangular bottom in a substantially trapezoidal shape;

a substantially circular and vertical lower hand-grip extending perpendicular to the substantially rectangular bottom substantially formed by the one or more sidewalls and the at least one cavity;

a horizontal lower hand-grip perpendicular to the vertical hand-grip and substantially formed by the one or more sidewalls and the at least one cavity, wherein the horizontal lower hand-grip comprises the point of connection between the substantially rectangular bottom and the one or more sidewalls; and a bumper assembly extending in a substantially perpendicular direction from the sidewall and comprising a bail ear for attaching a handle, an upper satellite ring, a lower satellite ring, a right upper handle comprising a top surface, a lower surface, and located at a first particular distance from the upper portion of the sidewall, and a left upper handle comprising a top surface, a lower surface, and located at a second particular distance from the upper portion of the sidewall, wherein:

an upper surface of the upper satellite ring forms the top surface of the right upper handle by sloping downwardly and forms the top surface of the left upper handle, wherein the top surface of the left upper handle is substantially co-planer with the upper surface of the upper satellite ring;

a lower surface of the lower satellite ring forms the lower surface of the right upper handle and forms the lower surface of the left upper handle, wherein the lower surface of the right upper handle is substantially co-planer with the lower surface of the lower satellite ring; and the first particular distance is a greater distance from the upper portion of the sidewall than the second particular distance.

* * * * *